US006615506B2

(12) United States Patent
Miller

(10) Patent No.: US 6,615,506 B2
(45) Date of Patent: Sep. 9, 2003

(54) PNEUMATIC HAIR CONDITIONER SYSTEM

(76) Inventor: Elizabeth A. Miller, 103 Magnolia Oak Dr., Longwood, FL (US) 32779

( * ) Notice: Subject to any disclaimer, the term of this patent is extended or adjusted under 35 U.S.C. 154(b) by 0 days.

(21) Appl. No.: 10/183,253

(22) Filed: Jun. 26, 2002

(65) Prior Publication Data

US 2002/0184785 A1 Dec. 12, 2002

Related U.S. Application Data

(62) Division of application No. 09/747,445, filed on Dec. 22, 2000, now Pat. No. 6,434,855.

(51) Int. Cl.[7] ..... A45D 20/00
(52) U.S. Cl. ..... 34/97; 34/96; 34/98; 34/92
(58) Field of Search ..... 34/96, 97, 98, 34/92; 392/380

(56) References Cited

U.S. PATENT DOCUMENTS 2,753,434 A * 7/1956 Storm, Jr. ..... 55/467
4,309,595 A * 1/1982 Long et al. ..... 392/385
4,314,405 A * 2/1982 Park ..... 30/133
4,479,311 A * 10/1984 Blanco ..... 34/90
4,721,121 A * 1/1988 Adams ..... 132/212
5,394,620 A * 3/1995 Chimera ..... 34/97

* cited by examiner

*Primary Examiner*—Denise L. Esquivel
*Assistant Examiner*—Kathryn S. O'Malley
(74) *Attorney, Agent, or Firm*—Allen, Dyer, Doppelt, Milbrath & Gilchrist, P.A.

(57) ABSTRACT

A pneumatic hair-conditioner system has a vacuum pump (1, 4, 6, 30) attached predeterminedly to a hair processor (2, 25, 28, 29, 31) which employs airflow to the vacuum pump for predetermined hair processing by the hair processor. The vacuum pump and the hair processor can be either a dedicated-process conditioner with permanently integral attachment and pneumatic communication of a single select processor for predeterminedly limited hair-processing use or a multi-process conditioner with detachable attachment and integral communication of a plurality of select processors for predeterminedly multiple hair-processing uses. Optionally, the vacuum pump can be reversible for blowing instead of sucking air in pneumatic communication with the hair processor. For blowing, application of heat also is optional.

8 Claims, 8 Drawing Sheets

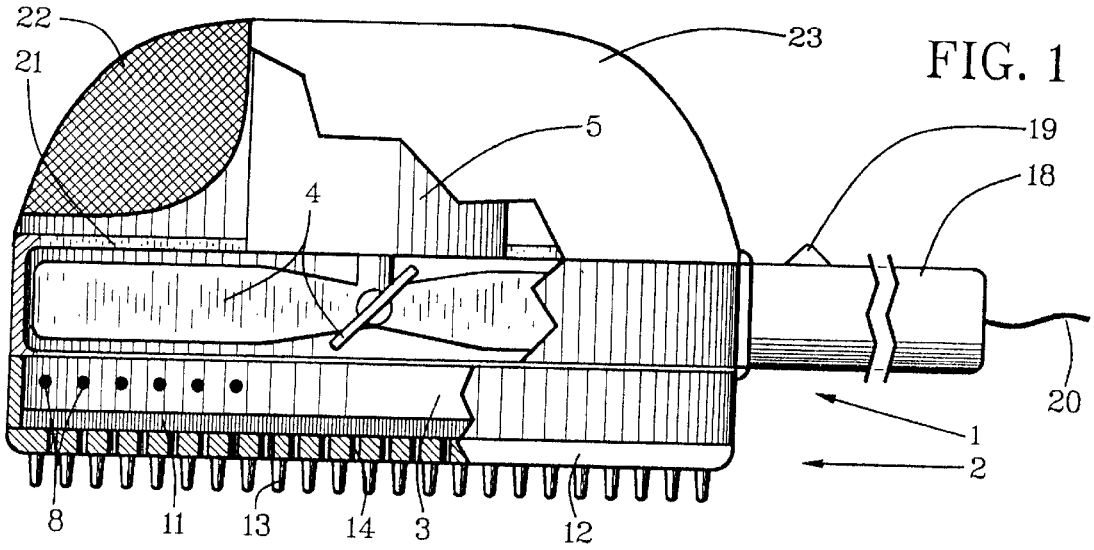
FIG. 1
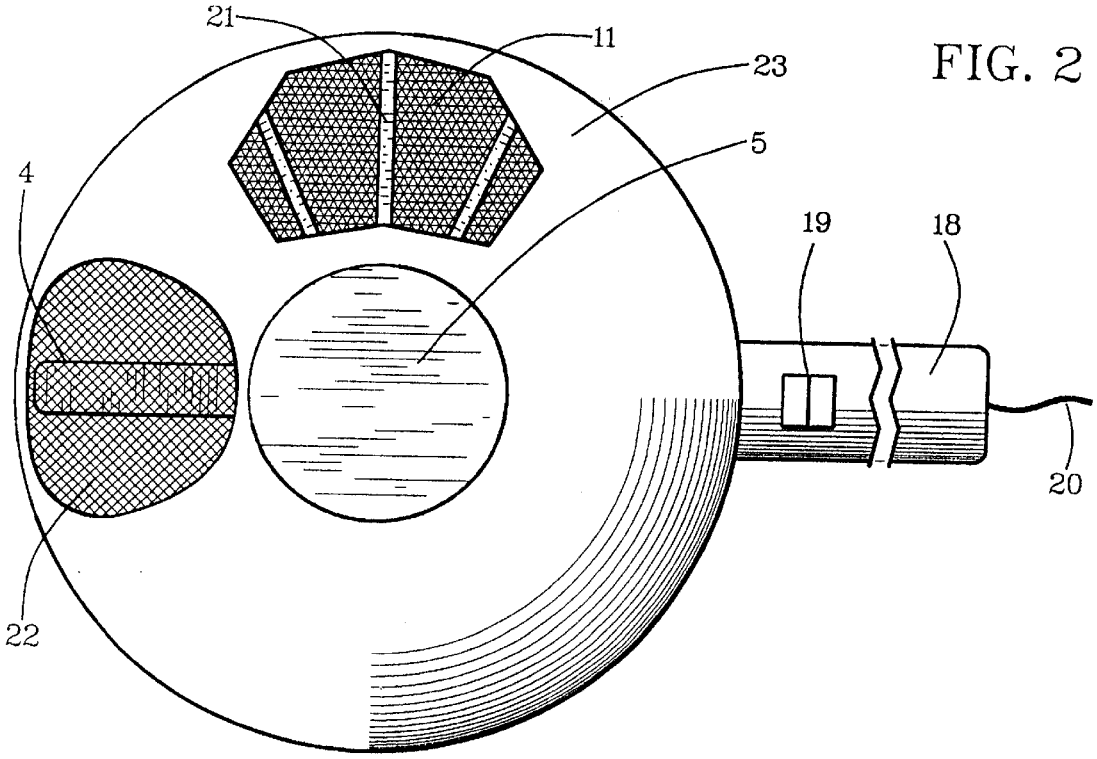
FIG. 2
FIG. 3
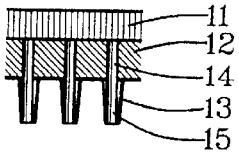
FIG. 4
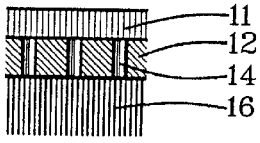
FIG. 5
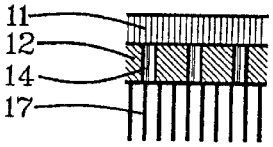

PNEUMATIC HAIR CONDITIONER SYSTEM

This is a division of application Ser. No. 09/747,445, filed on Dec. 22, 2000, now U.S. Pat. No. 6,434,855.

BACKGROUND OF THE INVENTION

This invention relates to a pneumatic hair-conditioner system having a vacuum-pump impeller attached integrally to a hair processor.

Numerous devices for treating hair pneumatically are known. Most in use at present are hair driers or blowers that blow controllably heated or unheated air onto hair. Previously, there have been suction hair treaters, many of which had tubular attachments to vacuum cleaners for pneumatic suction power.

There are none known, however, that have a hair processor in pneumatic communication with an integral vacuum-pump impeller and a handle for a pneumatic hair conditioner system in a manner taught by this invention.

Examples of most-closely related known but yet different devices are described in the following patent documents. U.S. Pat. No. 3,082,466, issued to Tucker, et al. on Mar. 26, 1963, described a barber's sanitary hair vacuum that strapped to a hand and had a suction tube attachable to a separate suction device such as a vacuum cleaner. U.S. Pat. No. 2,866,221, issued to Warva on Dec. 30, 1958, described a hair brush with suction orifices in communication with a suction tube that was attachable to a vacuum-cleaner fitting. U.S. Pat. No. 2,555,941, issued to Snowman on Jun. 5, 1951, described a hair and scalp cleaning device having a plurality of small fingers with suction bores in communication with a hollow body with a tube that coupled with a vacuum cleaner. U.S. Pat. No. 2,276,886, issued to Smith on Mar. 17, 1942, described a hair and scalp cleaning device with a suction head adapted to be connected to a separate suction-producing mechanism and having grooves leading to an orifice in communication with the suction head. It also was limited to a comb with hollow wedge-shaped teeth that slid in and out of the grooves. U.S. Pat. No. 1,859,714, issued to Rapids on May 24, 1932, and U.S. Pat. No. 1,853,226, issued to Rapids on Apr. 24, 1932, described different versions of a hair cleaning device having a hollow body in communication with narrow, flat and hollow teeth through which hair was sucked into the hollow body which was in communication with a hose of an un-described air-suction device.

SUMMARY OF THE INVENTION

Objects of patentable novelty and utility taught by this invention are to provide a pneumatic hair-conditioner system which:

- can hold hair in place while it is being dried or cleaned pneumatically;
- has a plurality of attachable hair-processor heads for a plurality of select hair-processing;
- has an integral vacuum-pump impeller;
- can be optionally reversible as a blower;
- does not require heat for effective hair drying and cleaning;
- has attachable processors for extremely long hair;
- has optional attachment of the vacuum-pump impeller to a hair-processing implement or placement of the vacuum-pump impeller nearby in tubular communication; and
- has hair-processing attachments for processing selectively small portions or total heads of hair.

This invention accomplishes these and other objectives with a pneumatic hair-conditioner system having a vacuum pump attached predeterminedly to a hair processor which employs airflow to the vacuum pump for predetermined hair processing by the hair processor. The vacuum pump and the hair processor can be either a dedicated-process conditioner with permanently integral attachment and pneumatic communication of a single select processor for predeterminedly limited hair-processing use or a multi-process conditioner with detachable attachment and integral communication of a plurality of select processors for predeterminedly multiple hair-processing uses. Optionally, the vacuum pump can be reversible for blowing instead of sucking air in pneumatic communication with the hair processor. For blowing, application of heat also is optional.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are explained briefly as follows:

FIG. 1 is a partially cutaway side view of a pneumatic hair conditioner having a vacuum pump with a reversible impeller and a short hair processor;

FIG. 2 is a partially cutaway top view of the FIG. 1 illustration;

FIG. 3 is a cutaway side view of projections having bores for a hair processor;

FIG. 4 is a cutaway side view of projections like a hair brush for a hair processor;

FIG. 5 is a cutaway side view of projections like a comb for a hair processor;

DESCRIPTION OF PREFERRED EMBODIMENT

Figure 6:
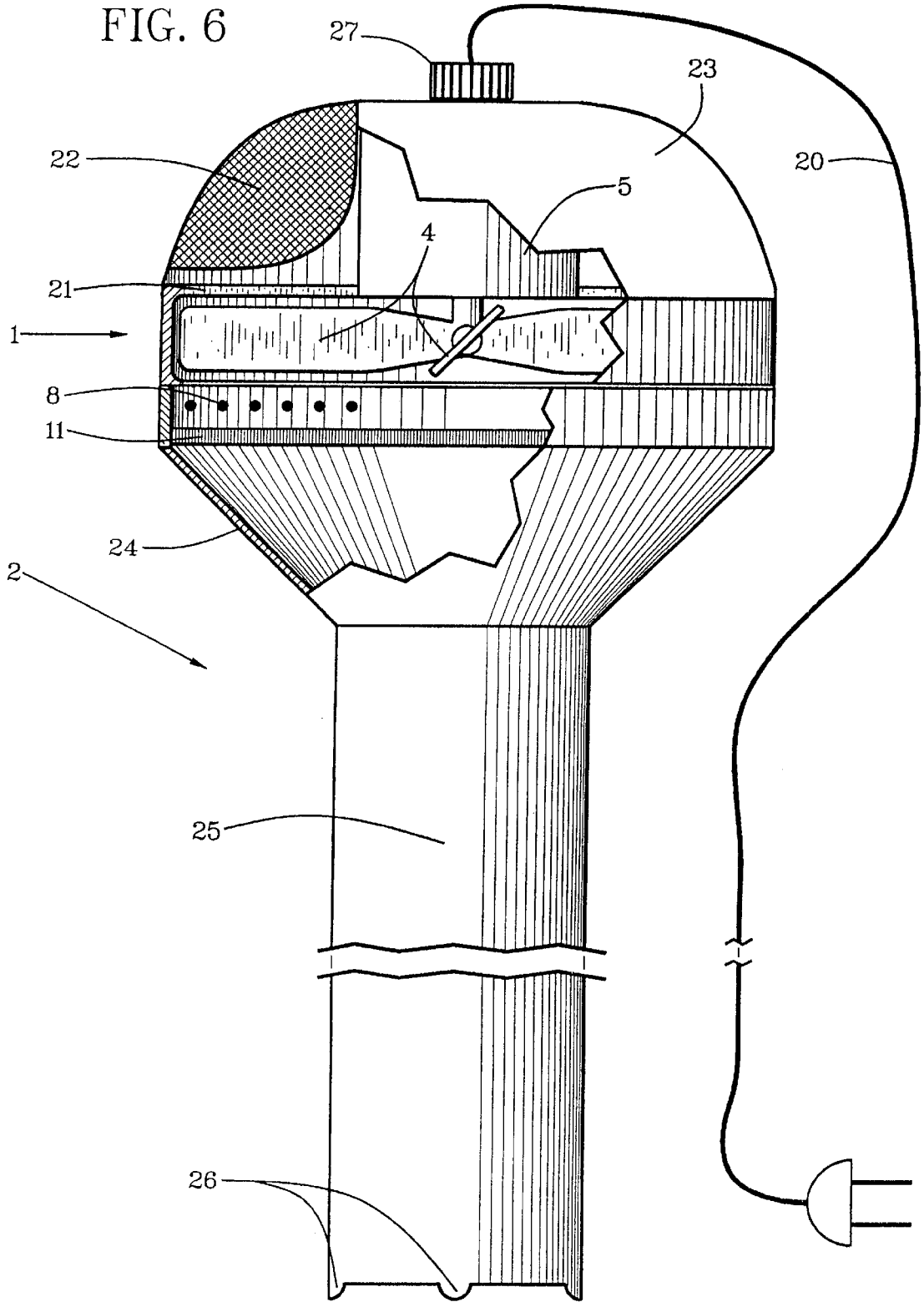
FIG. 6 is a partially cutaway side view of the FIG. 1 illustration with a tubular processor for processing long hair.

Listed numerically below with reference to the drawings are terms used to describe features of this invention. These terms and numbers assigned to them designate the same features throughout this description.

1. Vacuum pump
2. Hair processor
3. Trunk conveyance
4. Propeller
5. Electric motor
6. Unidirectional impeller
7. Blower
8. Resistance heater
9. Blower resistance heater
10. Outlet conveyance
11. Replaceable filter
12. Base
13. Projections
14. Base inlets
15. Bores
16. Brushlike projections
17. Comblike projections
18. Side handle
19. Switch
20. Electrical cord
21. Retainer member
22. Protective screen
23. Cover
24. Tubular base
25. Tubular processor
26. Serrations
27. Rotary switch
28. Domed processor
29. Processor bonnet
30. Integrally separate vacuum pump
31. Processor tube
32. Top-tube handle
33. Side-tube handle
34. Stand attachment
35. Bonnet stand
36. Multi-use hanger Reference is made first to FIGS. 1–5 and 13–14. A vacuum pump 1 has an electrically powered impeller attached predeterminedly to a hair processor 2 which is structured for employment of airflow in pneumatic communication with the vacuum pump 1 for predetermined hair processing. The vacuum pump 1 and the hair processor 2 include a multiple-process conditioner having detachable attachment of a plurality of select hair processors 2 to the vacuum pump 1. Optionally to the detachable attachment for a multiple-process conditioner, the vacuum pump 1 can include a predetermined dedicated-process conditioner dedicated to one or more predetermined hair processes. No difference is shown between the multiple-purpose conditioner and the dedicated-process conditioner because the difference can be indiscernible but for glue or unitary construction instead of detachable attachment.

Different from previous known hair-treatment devices using vacuum airflow, the vacuum pump 1 is attached detachably or permanently to the hair processor 2 directly instead of using a vacuum cleaner or other nondescript vacuum source. The vacuum pump 1 and the hair processor 2 are one integral unit that can be carried and used conveniently instead of being separate as for previous devices. Instead of various connections to the previous nondescript vacuum sources or vacuum cleaners, there is an interconnecting trunk conveyance 3 that is an integrated part of this pneumatic hair-conditioner system for pneumatic communication intermediate the hair processor 2 and the vacuum pump 1.

Figure 13:
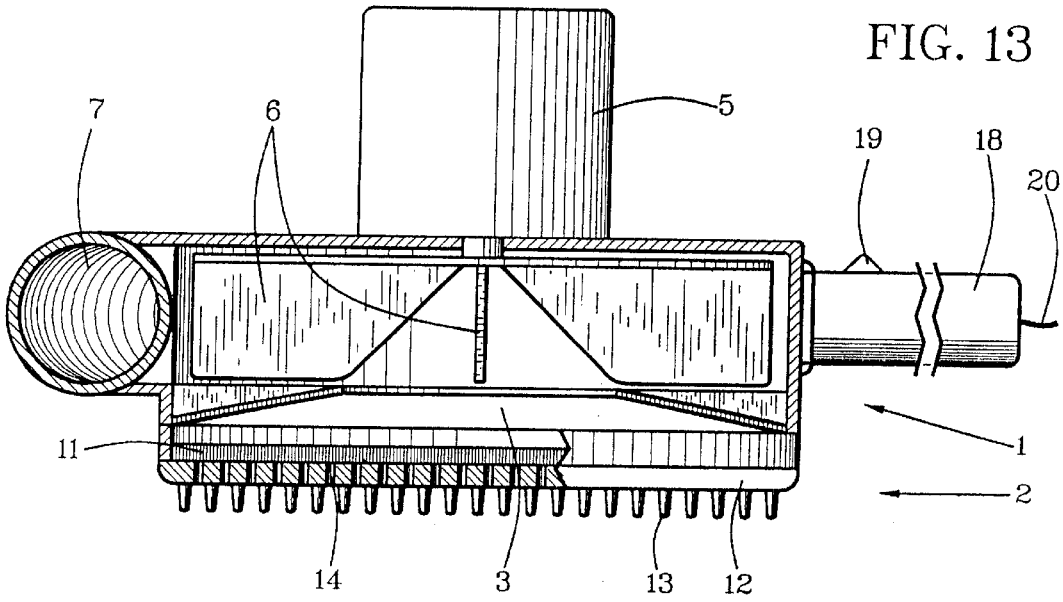
FIG. 13 is a partially cutaway side view of a pneumatic hair conditioner that is reversible with the hair processor on an intake side of a unidirectional impeller and a blower on an outlet side of the unidirectional impeller.
Figure 14:
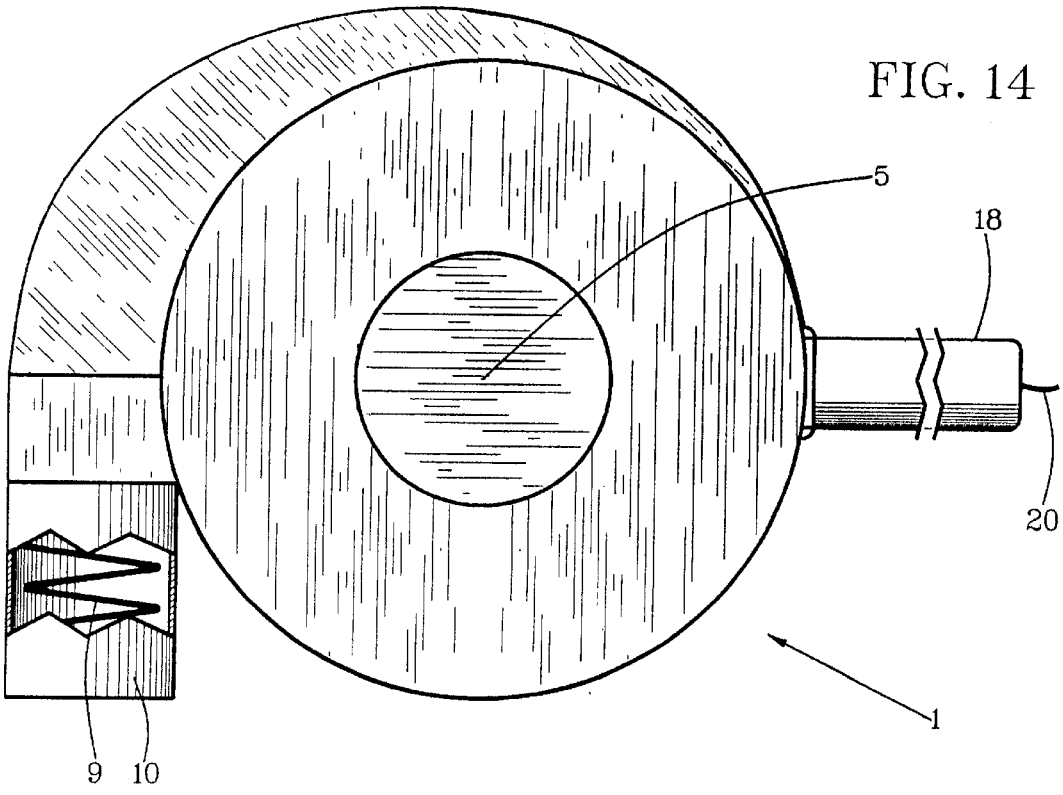
FIG. 14 is a partially cutaway top view of the FIG. 13 illustration with a resistance heater in an extension of an outlet port on an outlet side of the unidirectional impeller.

The vacuum pump 1 can be reversible to vacuum-pump air and to blow air selectively. This can be accomplished with a reversible impeller that can include a propeller 4 powered by an electric motor 5 that is reversible rotationally as shown in FIGS. 1, 6, 7, and 8. Optionally as shown in FIGS. 13–14, the pneumatic hair-conditioner system can be reversible with the hair processor 2 on an intake side of a unidirectional impeller 6 and a blower 7 on an outlet side of the unidirectional impeller 6. Either a reversible or a unidirectional vacuum pump 1 can be used with the hair processor 2, the only difference being reversibility with application of the resistance heater 8 in the trunk conveyance 3.

As depicted in FIGS. 1, 6, 7 and 8, a resistance heater 8 in the trunk conveyance 3 can be operable selectively in combination with a vacuum pump 1 that is reversible with the reversible impeller that includes the propeller 4 powered by the electric motor 5 that is reversible. Heating with the resistance heater 8 is applicable only for blowing, not for vacuum-processing hair. As depicted in FIGS. 13–14, a blower resistance heater 9 in an outlet conveyance 10 on the outlet side of the unidirectional impeller 6 is operable for the pneumatic hair-conditioner system that is reversible with the hair processor 2 on the intake side of the unidirectional impeller 6 and the blower 7 on the outlet side of the unidirectional impeller 6.

A replaceable filter 11 intermediate the hair processor 2 and the vacuum pump 1 is particularly significant for vacuum-processing hair because it prevents hair from entering the impeller in addition to collecting and preventing spread of particles removed from hair.

The hair processor 2 includes a base 12 having adaptable construction from which a selection of processor projections can be extended for processing hair. Included can be projections 13 adjacent to base inlets 14 as shown in FIG. 1, the projections 13 having bores 15 as shown in FIG. 3, brushlike projections 16 as shown in FIG. 4, and comblike projections 17 as shown in FIG. 5.

A side handle 18 can be attached to a side with a convenient switch 19 for on/off and speed regulation in proximity to an electrical cord 20 for short hair processors 2. For using a propeller 4, retainer members 21 can be employed to maintain the replaceable filter 11 in place and a protective screen 22 can be positioned over an airflow orifice. Seen differently from a side in FIG. 1 than from a top through a cutaway in a cover 23, the replaceable filter 11 is shown accordingly different.

Figure 7:
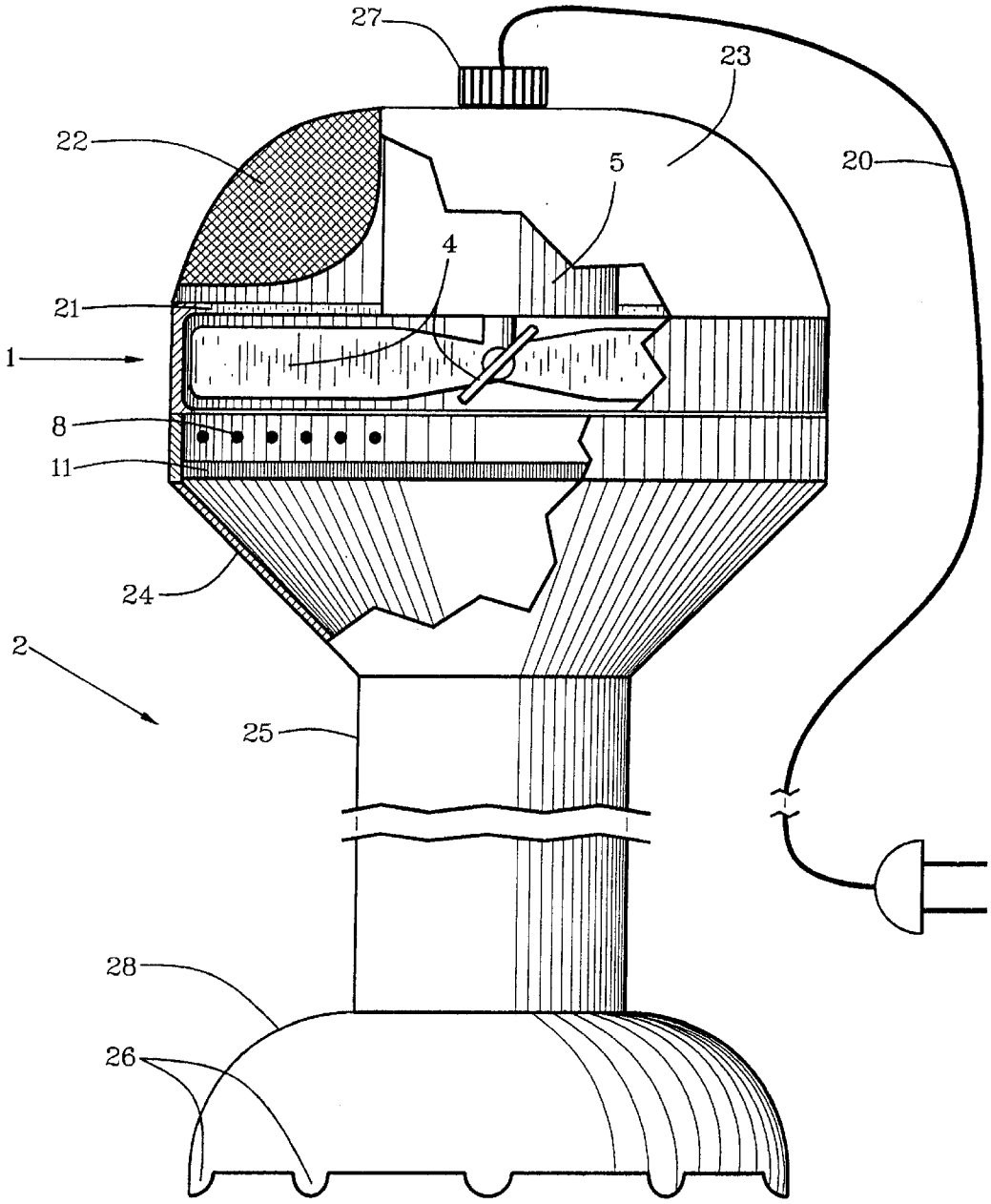
FIG. 7 is a partially cutaway side view of the FIG. 6 illustration with addition of a domed processor.
Figure 8:
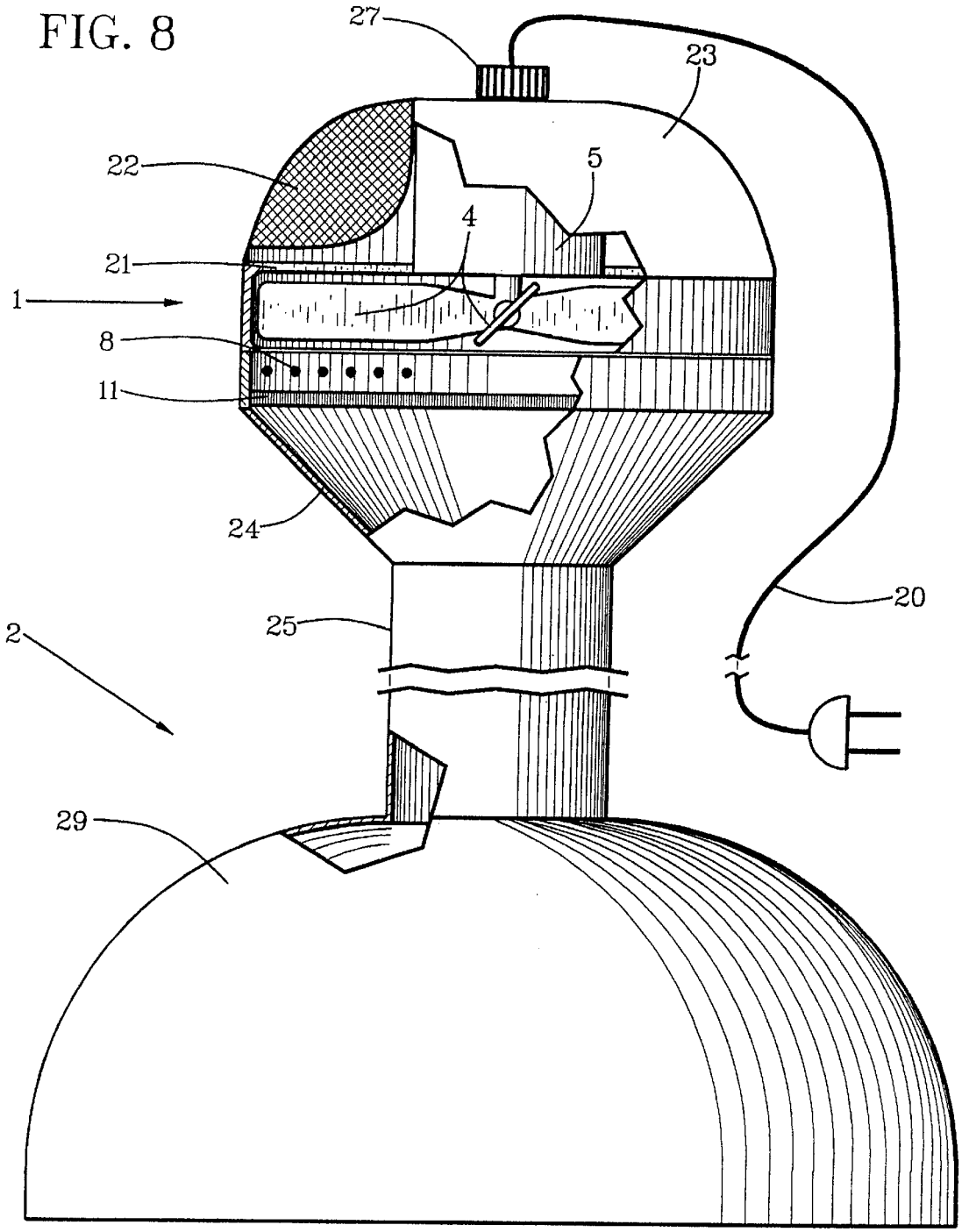
FIG. 8 is a partially cutaway side view of the FIG. 6 illustration with addition of a processor bonnet.
Figures 9, 10:
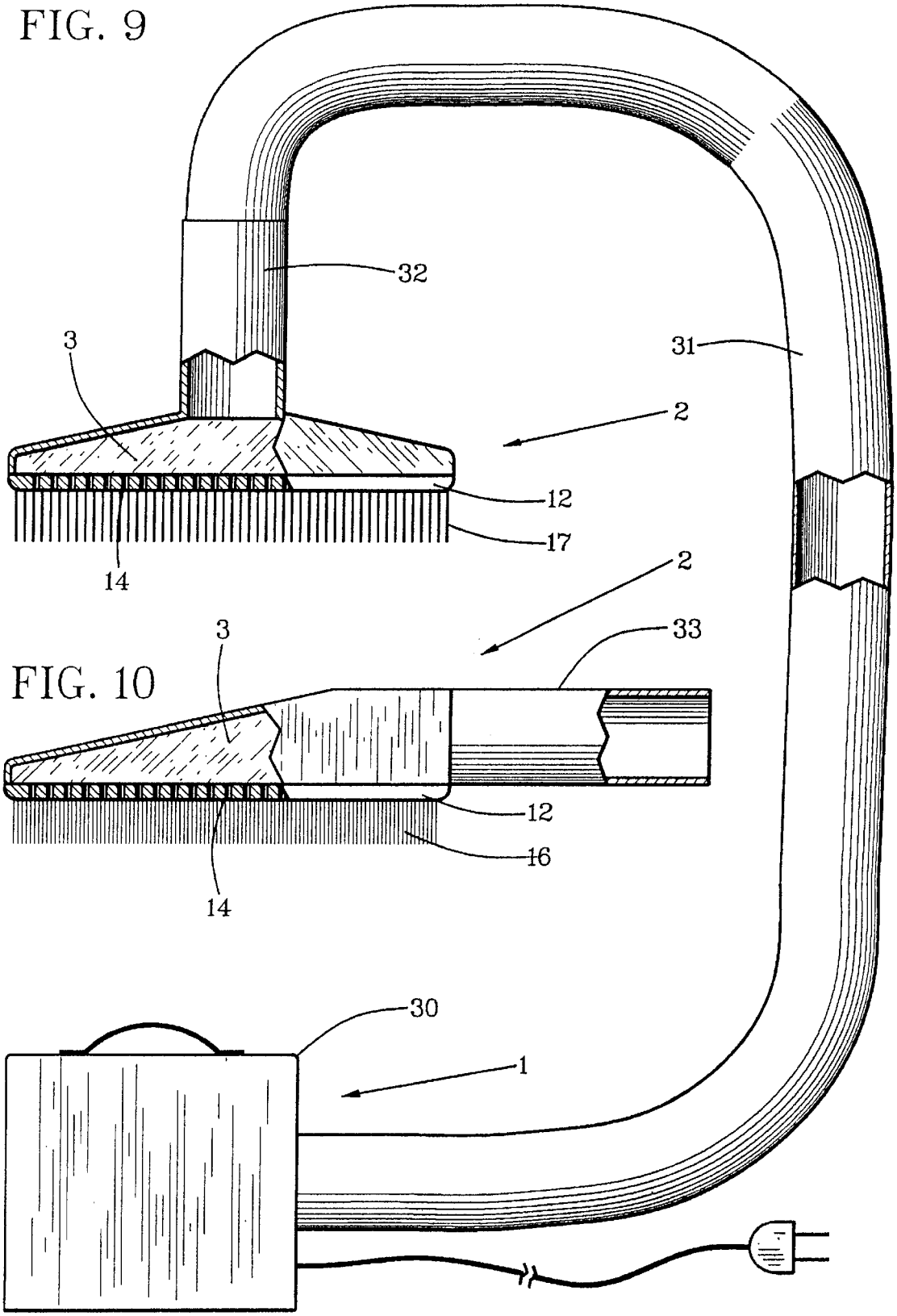
FIG. 9 is a partially cutaway side view of a pneumatic hair conditioner having a vacuum pump with processor-tube attachment to a hair processor having a top-tube handle.
FIG. 10 is a partially cutaway side view of a side-tube handle for the FIG. 9 processor-tube attachment.

Referring to FIGS. 6–8, the base 12 shown in relation to FIGS. 1 and 3–5 can be adapted to long processors particularly for processing long hair as depicted by a tubular base 24 for attachment of a tubular processor 25 having an inside periphery and a length to contain a predetermined amount and length of hair intermediate a hair-inlet end of the tubular processor 25 and the vacuum pump 1. The hair-inlet end of the tubular processor 25 is preferably serrated with serrations 26 that preferably have arcuate structure for contact with hair and scalp. The tubular processor 25 can be grasped as a handle in lieu of the side handle 18 shown in FIGS. 1–2. For this embodiment, the electrical cord 20 can be attached at an end of the electric motor 5 proximate an optional rotary switch 27. As depicted in FIG. 7, the hair processor 2 described in relation to FIG. 1 can include a domed processor 28 having a scalp-contact end with a periphery to contact a predetermined scalp area and an attachment end attached detachably or permanently to optionally the tubular processor 25, the tubular base 24 or the base 12. The scalp-contact end of the domed processor 28 can be serrated with the serrations 26 as described in relation to FIG. 6.

As depicted in FIG. 8, the hair processor 2 described in relation to FIG. 1 can include a processor bonnet 29 having an inside periphery to receive a head and hair of a person predeterminedly. The inside periphery of the processor bonnet 29 has an attachment end attached detachably or permanently to optionally the tubular processor 25, the tubular base 24 or the base 12.

Referring to FIGS. 9–12, the vacuum pump 1 described in relation FIG. 1 can be an integrally separate vacuum pump 30 having an electrically powered impeller with processor-tube attachment with a processor tube 31 to a hair processor 2, described in relation FIG. 1, which is structured for employment of airflow in pneumatic communication with the integrally separate vacuum pump 30 for predetermined hair processing with both the hair processor 2 and the processor tube 31 predeterminedly. The integrally separate vacuum pump 30, the processor tube 31 and the hair processor 2 include a multiple-process conditioner having predetermined detachable attachment of a plurality of select hair processors 2 to the processor tube 31. The predetermined detachable attachment includes connection and disconnection of pneumatic communication intermediate the processor tube 31 and the hair processor 2. The integrally separate vacuum pump 30 and the processor tube 31 are attached detachably to the hair processor 2 and the hair processor 2 has at least one base inlet 14 to the processor tube 31.

The integrally separate vacuum pump 30 is reversible to blow air and to partial-vacuum-pump air selectively.

The hair processor 2 includes the base 12 from which a plurality of the projections, including the brushlike projections 16 and the comblike projections 17, can be extended in proximity to the base inlets 14 in pneumatic communication with the trunk conveyance 3 as described in relation to FIGS. 1–5.

The processor tube 31 has an inside periphery and a length to receive a predetermined amount and length of hair for processing separately from or in combination with the hair processor 2.

The hair processor 2 for attachment to the processor tube 31 can have a top-tube handle 32 or optionally a side-tube handle 33 in pneumatic communication intermediate the hair processor 2 and the processor tube 31.

Figure 11:
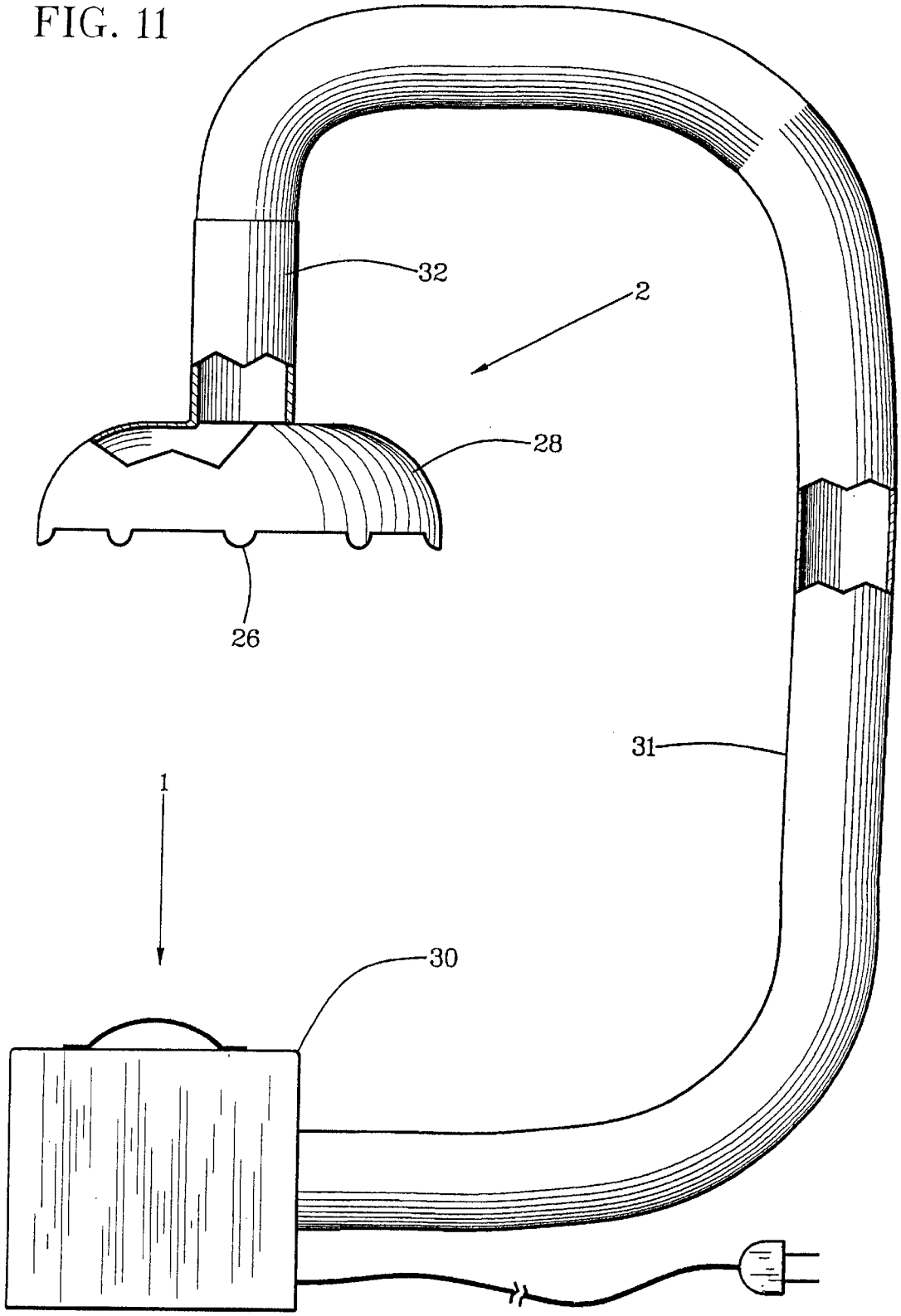
FIG. 11 is a partially cutaway side view of the FIG. 9 illustration with a domed processor attached to the processor tube.

As depicted in FIG. 11, the hair processor 2 for attachment to the processor tube 31 can have the domed processor 28 with or optionally without the serrations 26 described in relation to FIG. 7. This allows long hair to enter the processor tube 31 easily while also working one's scalp with the serrations 26 which also allow entry of hair and vacuum air for a vacuum airflow.

Figure 12:
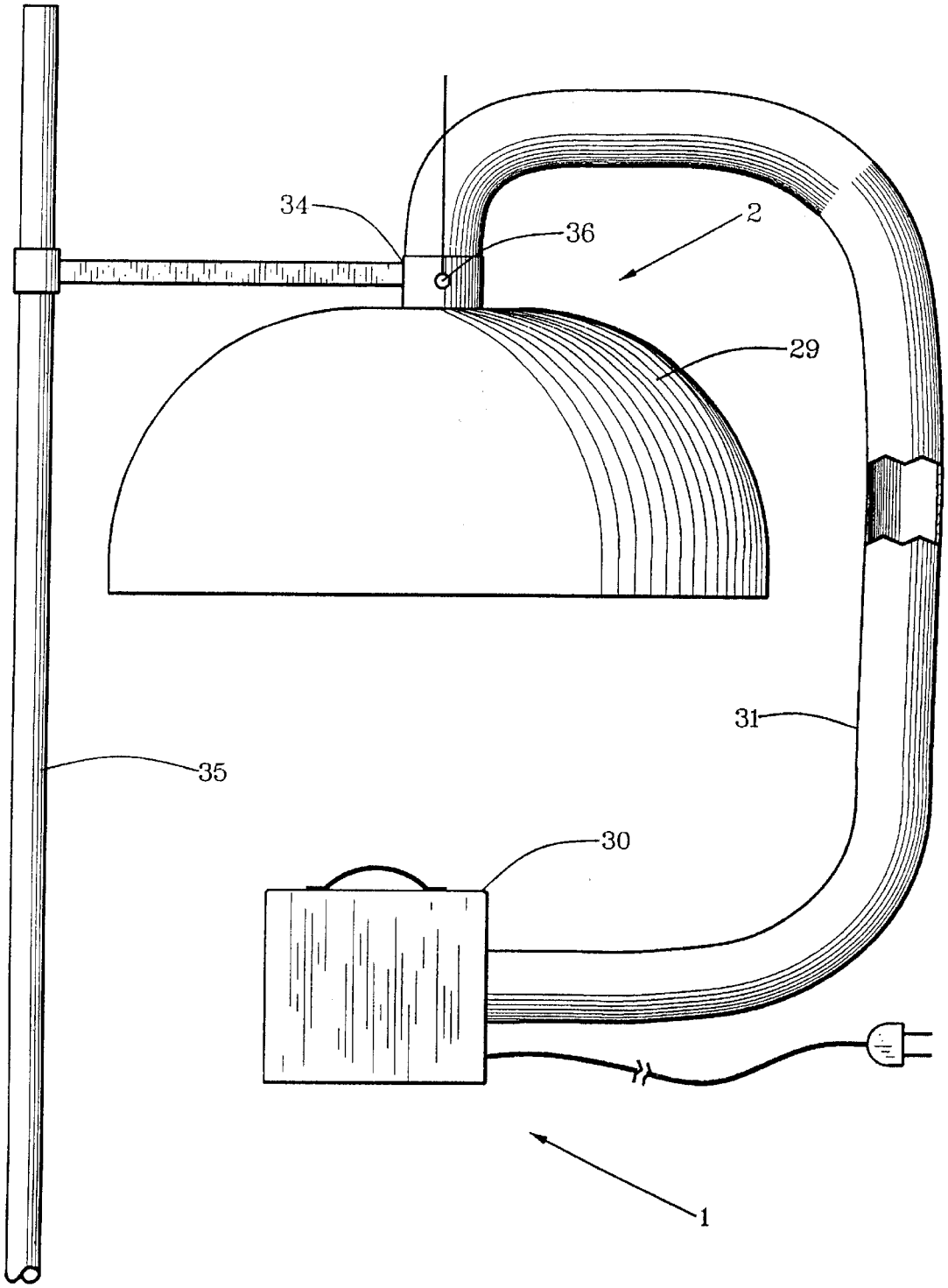
FIG. 12 is a partially cutaway side view of the FIG. 9 illustration with a processor bonnet attached to the processor tube.

As shown in FIG. 12, the hair processor 2 includes the processor bonnet 29 having an inside periphery to receive a head and hair of a person predeterminedly with the inside periphery of the processor bonnet 29 in pneumatic communication with the processor tube 31. The processor bonnet 29 can have a stand attachment 34 for attachment to a bonnet stand 35. A multi-use hanger 36 also can be provided on the processor bonnet 29.

A new and useful pneumatic hair-conditioner system having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A pneumatic hair-conditioner system comprising:

a vacuum pump having an electrically powered impeller attached integrally to a hair processor having a base with an outer surface, the pump and the hair processor structured for employment of air flow through the hair processor in order to draw moisture out of hair in contact with the outer surface of the base;

the vacuum pump and the hair processor include a predetermined dedicated-process conditioner dedicated to one or more predetermined hair processes;

the vacuum pump is attached to the hair processor directly;

the hair processor having at least one processor inlet to a trunk conveyance in pneumatic communication intermediate the hair processor and the vacuum pump; and means immediately adjacent the base for preventing hair from passing into the hair processor.

2. The pneumatic hair-conditioner system of claim 1 wherein:

the vacuum pump is reversible with a reversible impeller to vacuum-pump air and to blow air selectively.

3. The pneumatic hair-conditioner system of claim 2 wherein:

the trunk conveyance has a resistance heater that is operable selectively.

4. Apparatus for pneumatically removing moisture from hair comprising:

an electrically powered vacuum pump having an impeller for drawing air through the pump;

a hair processor fitted integrally with the pump, the hair processor having a base with an outer surface for passing across the hair to be treated, the base processor having multiple apertures therein for the passage of air therethrough in response to operation of the impeller;

means between the processor base and the impeller and flush with the processor base for preventing hair from passing into the processor; and dimensioning the apertures of the processor base and operating the impeller in a manner sufficient to draw moisture from hair against which the hair processor is placed.

5. The apparatus recited in claim 4, wherein the means for preventing hair from passing through the processor is flush with an inner surface of the processor base opposing the outer surface.

6. The apparatus recited in claim 4, wherein the apertures and the distance between the preventing means and extremities of the base outer surface are dimensioned so as to prevent the passage of hair into the apertures.

7. Apparatus for removing moisture from hair, comprising:

a housing with an inner chamber and an outer wall dimensioned to engage hair to be treated for removal of moisture, and with a plurality of openings extending through the wall;

means for drawing air and moisture from hair engaging the outer wall through the openings and into the inner chamber;

means adjacent the outer wall for preventing hair from passing into the inner chamber; and means for passing moisture-laden air from the inner chamber out of the housing.

8. A method for pneumatically removing moisture from hair, the method comprising the steps of:

providing an electrically powered vacuum pump having an impeller for drawing air through the pump;

fitting a hair processor integrally with the pump, the hair processor having a base with an outer surface for passing across the hair to be treated, the processor base having multiple apertures therein for the passage of moisture-laden air therethrough in response to operation of the impeller;

inserting means between the processor base and the impeller and flush with the processor base for preventing hair from passing into the processor; and dimensioning the apertures of the processor base and operating the impeller in a manner sufficient to draw moisture from hair against which the hair processor is placed.

* * * * *